United States Patent [19]

Seragnoli

[11] 3,972,271

[45] Aug. 3, 1976

[54] APPARATUS FOR PRODUCING UNDERSTRIPS FOR HINGE LID CIGARETTE PACKETS

[75] Inventor: Enzo Seragnoli, Bologna, Italy

[73] Assignee: G. D. Societa per Azioni, Italy

[22] Filed: Nov. 8, 1974

[21] Appl. No.: 522,299

[30] Foreign Application Priority Data

Dec. 20, 1973 Italy ..... 3542/73

[52] U.S. Cl. ..... 93/58.2 R; 83/152; 83/451; 93/12 C; 93/57; 93/58.3

[51] Int. Cl.[2] ..... B31B 1/16

[58] Field of Search ..... 83/152, 348, 451, 374; 93/57, 36.01, 58 R, 58.2 F, 58.3, 12 C, 12 R, 39 R, 55, 55.1 P

[56] References Cited

UNITED STATES PATENTS

| | | | |
|---|---|---|---|
| 2,429,944 | 10/1947 | Rayburn et al. | 83/348 X |
| 2,591,135 | 4/1952 | Chalmers et al. | 93/39 R X |
| 2,851,933 | 9/1958 | Bradford, Jr. et al. | 93/58.3 |
| 2,870,584 | 1/1959 | Sherrill | 93/12 C |
| 3,176,558 | 4/1965 | Gustavson | 83/152 X |
| 3,598,009 | 8/1971 | Regec | 83/152 X |
| 3,779,140 | 12/1973 | Yamamura | 93/55 X |
| 3,844,201 | 10/1974 | Eggert et al. | 93/58 R X |

*Primary Examiner*—James F. Coan
*Attorney, Agent, or Firm*—Robert E. Burns; Emmanuel J. Lobato; Bruce L. Adams

[57] ABSTRACT

Apparatus for producing understrips for cigarette packets of the hinge lid type. A web of the reel-wound cardboard material is dragged along an infeed track, intermittently, by rolls which operate in conjunction with counter rollers and make on the web, parallel with its forward motion, two rows of indentations, punctuated with notches. A cutting device is placed transversely to the infeed track. It consists of a reciprocally movable knife and a stationary knife, and operates in a phase relationship with the web feeding, indenting and notching roll and counter rollers, such that all understrips, detached from the continuous web, are identical. The movable knife has means for holding the understrip detached from the continuous web and for thereby presenting the understrip to apparatus for additionally shaping it and transferring it.

10 Claims, 3 Drawing Figures

APPARATUS FOR PRODUCING UNDERSTRIPS FOR HINGE LID CIGARETTE PACKETS

BACKGROUND OF THE INVENTION

This invention relates to machines for packing cigarettes in packets of what are known as the 'hinge lid' type and, to be more precise, has as its subject a device for producing the understrips or 'shoulder pieces' which constitute a vital part of this type of packet.

DESCRIPTION OF THE PRIOR ART

A packet of the hinge lid type is produced by a cardboard blank of known type, to which is bonded one of the understrips, subjected to a number of folding operations.

The final result is a box or parallelepiped packet of the type shown in FIG. 1, consisting of a body 1 and a lid 2 which are interconnected by means of a hing 3.

At 4 there is an understrip or shoulder piece bonded internally to the body 1. This piece is made up of a center panel 5 and two identical side pieces 6. The center panel 5 has an upper recess 5*a* and a lower projection 5*b*, both having oblique sides.

Each side piece 6 is separated from the center panel 5 by a series of indentations 7 along which the folds are made and by the notch 8, the purpose of which will be seen in due course (see also FIG. 2 where one of the understrips 4 is shown during a stage preceding its use).

As can be seen from FIG. 1, the understrip, which has its center panel 5 bonded to the front of the packet and its side pieces 6 bonded to the lateral walls of the body 1, protrudes above that part of the packet where the opening is, in such a way as to create continuity and sealing action between the body 1 and the lid 2 once the packet is closed.

Protrusions 8', formed at the time the side pieces 6 are folded where the previously mentioned notches 8 are located, serve to increase the contact between the understrip 4 and the lid 2 and to lock the latter down when the packet is closed.

The understrips 4 are produced on the same machine used to pack the cigarettes in their hinge lid packets and are removed from a reel of cardboard material through a cutting operation.

In the known art, the task of producing the understrips 4 is given to a pair of counter rotating rollers mounted on parallel horizontal spindles and kept in close contact with each other, in between which a continuous web of material unwound from a reel by infeed devices is inserted.

One of the conventionally used rollers consists of a cylindrical core whose surface has fixed to it a plurality of plates fitted with cutting profiles, of which a part, acting in conjunction, detach the individual understrips from the continuous reel, while the remainder serve to make in each understrip the series of indentations 7 and the notch 8.

The other roller in the pair is provided purely for back-up purposes.

The number of cutter plates it is possible to fit on the first mentioned roller depends on its diameter. This number must be more or less large so that each time the roller completes one full revolution, a corresponding number of finished understrips be produced.

It is, therefore, obvious that the roller with the plates provided with cutting profiles may not only be very costly but also exceedingly complicated to put together since it is made up of a large number of parts.

Furthermore, it should be borne in mind that this laborious plate assembly operation has perforce to be repeated, either fully or in part, at each grinding operation in order to allow plates of a suitable gauge to be interposed between the surface of the cylindrical core and the plates whose cutting profiles are imperfect.

Otherwise if material from the cutting profiles were to be simply shaved off, there would be a loss of contact between the ground profiles and the cutting plane.

Because of the particular way in which the cutting profiles are shaped to reproduce the outlines, the notch and the indentations in the understrips 4, the grinding operation calls for use of complicated, costly equipment and for very accurate final checks.

All this suggests the use of highly skilled personnel, not always available everywhere.

For these reasons it is often preferable, in order to avoid the complicated series of reassembling and rechecking operations, to replace the worn roller with a new one, which however is expensive and wasteful.

A further disadvantage of the devices constructed in accordance with the known methods used in the art, is that the cutting operation to separate the individual understrips from the continuous web is incomplete since it is performed with a cutting profile that is not continuous, made up of a succession of cutting profiles on numerous plates.

The removal of each individual understrip from the continuous web at the points where, due to the breaks in the continuity of the cutting profile, it is still joined thereto has to be completed by a tearing action which results in jagged edges being left in the detached understrip.

SUMMARY OF THE INVENTION

The object of the present invention is, therefore, to overcome the aforementioned difficulties by making available a device of the type to which reference has been made above but is which structurally extremely simple and low in cost.

A further object of the invention is to provide a device able to achieve the foregoing and to produce perfectly made understrips.

Yet another object of the invention is to provide a device able to achieve the foregoing, yet to offer a particularly simple, quick and economical way of carrying out the grinding operation.

The invention therefore provides, a structure which defines a track for infeeding cardboard web material; rolls and counter rolls adjacent the intermittently for moving the web forward, while making in the web two rows of indentations regularly punctuated by notches, in a direction parallel to that in which the material moves forward; and a separate cutting device positioned transversely with respect to the track, preferably consisting of a movable knife and a stationary knife. The movable knife operates in phase relationship with the intermittently moving, means for indenting and notching the material, such that the individual understrips which the knife detaches from the web are all identical. Preferably the understrip detached from the web is held on the movable knife, to be picked up in proper position by further shaping and transferring apparatus. Also, preferably the movable knife is moved in a reciprocating fashion

BRIEF DESCRIPTION OF THE DRAWINGS

Further characteristics and advantages will emerge more clearly from the following detailed description of a preferred form of embodiment for the device according to the invention, illustrated purely as an example on the accompanying drawings in which.

DESCRIPTION OF THE PREFERRED EMBODIMENT

Figure 3:
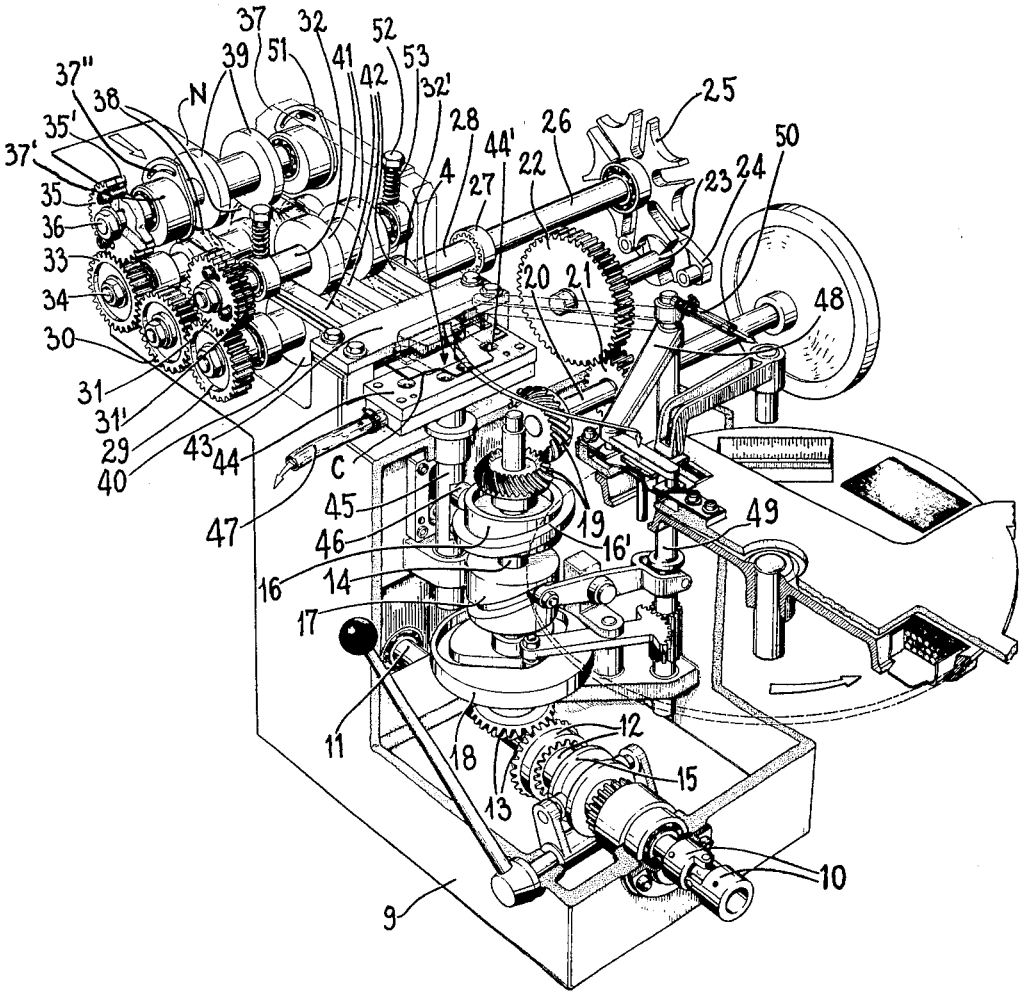
FIG. 3 shows, again in a perspective view, the device for the production of understrips or shoulder pieces, together with the means used to operate it.

With reference to the above mentioned figures and, in particular, to FIG. 3, at 9 there is the bedplate for the device forming the subject of the present invention, which is secured to the frame (not shown in the figure) of the machine for packing cigarettes in packets of the hinge lid type.

The entire device is powered by means not illustrated in FIG. 3 which belong to the aforementioned machine, through a coupling 10 integral with a horizontal shaft 11 which is consequently drawn in rotation around its own axis.

Through a dog clutch 12 and a bevel gear and pinion 13, the drive is passed from the shaft 11, supported by the bedplate 9, to a vertical shaft 14.

This mechanical connection can be broken be a cam 15 integral with the above mentioned clutch 12 and using manually operated means.

Mounted on the vertical shaft 14 from top to bottom, in the order stated, are a cam 16, the purpose of which will be seen in due course and two cams 17 and 18 which serve to pass the drive on to the other devices, mentioned hereinafter and which are the subject of a separate Patent Application in the name of the same Applicant as herein, namely Patent Application Ser. No. 522,457 filed Nov. 8, 1974.

Furthermore, from the upper extremity of shaft 14, the drive is transmitted, through a pair of helical gears 19, to a horizontal shaft 20 on which is keyed a gearwheel 21.

In turn, the gearwheel 21 meshes with a gear 22 rigidly mounted on one end of a horizontal shaft 23.

The other extremity of the shaft 23 is keyed to a device 24, of a known type, provided with two loose pins or needles and two arcuate or centering devices.

The pins and centering devices are destined to operate a six space Geneva ratchet mechanism 25 which thereby, each time the said device 24 completes one full rotation, is moved two steps around, with a horizontal shaft 26 on which it is mounted.

This intermittent rotatory movement is passed on through a coupling 27 from the shaft 26 to a horizontal shaft 28 onto one end of which is keyed a gear 29 which serves to pass the drive on to an idle gear 30 and to two identical gears 31 and 31', placed side by side on a shaft 32, above the idle gear 30.

The latter meshes with a gear 33 mounted on a shaft 34 and which, in turn, meshes, as just seen for the gear 29, with two identical gears 35 and 35', placed side by side above it on a shaft 36.

The shafts 28, 32 and 34, 36 which are horizontal and parallel with one another, are supported by bearings 32', 37' on mutually from the opposite walls of a housing 37 anchored to the bedplate 9 of the device forming the subject of the present invention.

Furthermore, the shaft 34 has rigidly mounted on it two rolls 38 cooperating with counter rolls 39 mounted on the shaft 36 and likewise, the shaft 28 carries two rolls 40 destined to operate in conjunction with rolls 41 keyed onto the shaft 32.

A continuous web N of cardboard material unwound from a reel not illustrated moves forward along a horizontal plane in the direction of the arrow and is inserted between the pairs of rolls 38 and 39.

Figure 2:
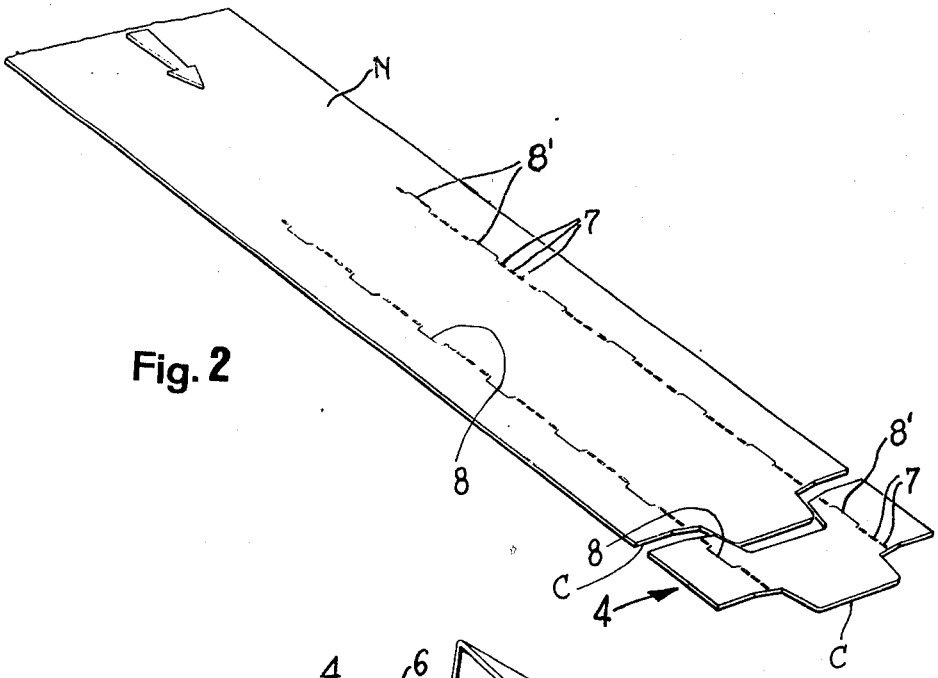
FIG. 2 shows, also in a perspective view, from left to right, the succession of various manufacturing phases to which a continuous web of cardboard material is subjected by the device according to the invention in order to prepare the understrips.
Figure 1:
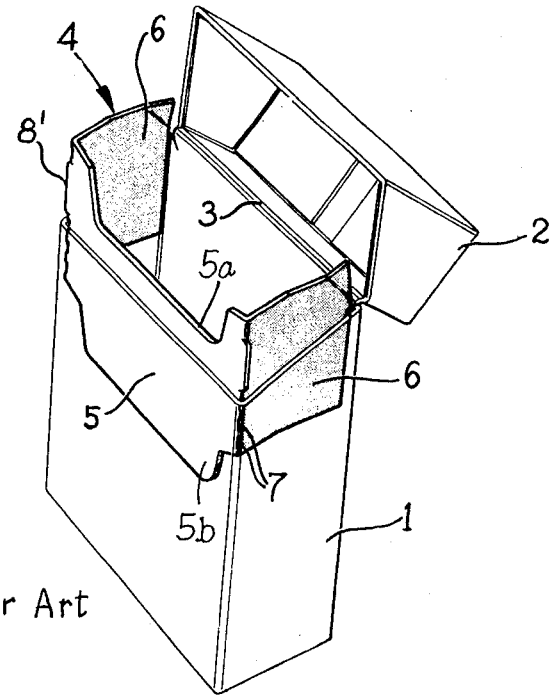
Prior Art Fig. 1
FIG. 1 shows, in a perspective view, a packet of the known hinge lid type with particular emphasis given to the understrip or shoulder piece.

By passing between the aforementioned pairs of rolls, the continuous web N changes in appearance. It is partly divided, longitudinally, into three areas, one in the center and two at the sides, as it is processed by devices placed circumferentially on each of the rolls 38 which make two parallel rows of indentations 7 punctuated from time to time by notches 8, as already explained in the statement of the Background of this Invention (see FIG. 2). One of these rolls is shown in FIG. 4.

The continuous web N thus moves forward intermittently along the tangential plane common to the above mentioned pairs of indenting rolls, drawn along by the pairs of feed rolls 40 and 41.

Past these rolls, the web N continues to move forward in the direction of the arrow, along a plane called the 'infeed plane', guided by three pairs of horizontal guide rails 42 positioned to extend along the two lateral areas and the center area. Each pair comprises one guide rail underlying the web and one overlying it, with sliding contact between the web and the guides. The feed rolls and scoring rolls are located between the pairs of guide rails, as shown.

At the final extremity of the guides 42 and placed transversely with respect to them, there is a cutting means consisting of two knives, one of which stationary, 43, and the other movable, 44, and these serve to divide the continuous web N, in which the indentations 7 and the notches 8 have already been made, into the individual finished understrips.

The stationary knife 43, consisting of a horizontal plate secured to the bedplate 9, has its lower side level with the infeed plane, on the right hand front edge of which, when looking at FIG. 3, its cutting profile is located.

The movable knife 44, also consisting of a horizontal plate, remains stationary at a lower level than the infeed plane while the web N is moving forward and has its cutting profile, which is destined to work in conjunction with that of the stationary knife 43, placed on the left hand rear edge, when looking at FIG. 3.

The knife 44 owes its movability to the fact that it is integral with a vertical shaft 45 supported by the bedplate 9 of the device according to the invention and free to slide axially relative to its means of support.

Two horizontal, parallel spindle mounted idle rollers 46 are carried on the shaft 45, and the guide lobe 16' of the previously mentioned cam 16, inserted in between these rollers, slides relative to them so that each time the cam 16 completes one full rotation, the shaft 45 and consequently also the movable knife 44, effect one vertical two way movement.

The top side of the plate that acts as the movable knife has drilled in it, suitably positioned, four holes 44' and these, each time a cutting operation is performed, are cyclically connected, through a pipe 47, to a source of suction not shown in FIG. 3.

With each upward travel of the movable knife, an understrip or shoulder piece is detached from the web N, by a cut C, as the web stands with the material stretching way past the cutting profile.

The severed understrip 4, attached by suction to the top side of the movable knife 44, via the holes 44', is thus lifted vertically from the cutting plane to an elevated position. From there it can be transferred to devices outside the scope of the present invention, such as, for example, those according to the aforementioned Patent Application in the name of the same Applicant as herein. Briefly, the transfer can be described as follows.

The transfer is carried out by an arm 48 pivoted to a vertical shaft 49. The arm 48, the extremity of which is also connected to a source of suction via a pipe 50, waits in the highest position attainable by the knife 44 for the top side of the understrip 4 to attach itself to the arm at the very moment when the source of suction applied through the holes 44' is cut off.

To conclude, as stated above, the preparation of the understrips or shoulder pieces takes place in successive stages, that is to say, there is an initial indentation and a notching stage on the part of the rolls 38–39, an intermediate transfer stage on the part of the rolls 40–41 and, finally, a cutting stage performed by the knives 43–44.

The best results, in other words understrips having uniformly the right longitudinal dimensions and with the notches 8 correctly positioned along the folding line 7 and with respect to the cuts C, can only be achieved when there is an absence of play between the transmission drive gears and no slippage between the rolls and the web N.

Anti-backlash gear means of a known type are used to prevent such play from arising at the gears 31 and 35 to which previous reference has been made. The gears are provided with through slots in order to allow them to rotate slightly with respect to the second gears 31' and 35'. In this way, with a single adjustment, it is possible to get the teeth in the said pairs of gears 31–31' and 35–35' to constantly mesh with those of the drive gears 29 and 33.

To prevent any possibility of the continous web N slipping while it moves relative to the indenting and notch-producing rolls and the cutting device, means are provided with which to regulate the pressure of the rolls by and between which it slides.

Insofar as the rolls 38 and 39 are concerned, the pressure regulation is, first and foremost, intended to enable the indentations 7 and the notches 8 to be properly made.

For this purpose the bearings for the shaft 36 are inside eccentric bushes 37' integral with the plates 51. These plates have circumferential arcuate slots 37'' in them are able to rotate in their races, machined into the walls of the housing 37 to such extent as is allowed by pins extending from these walls into the slots.

It is clear that these rotations result in variations being made to the pressure between the cutter rolls 38 and the rolls 39.

Finally, the bearings 32' for the shaft 32, which also run in slots machined into the bedplate, are subjected to the action of means for regulating the pressure of the rolls 41, consisting of screws 52 secured to the housing 37 and restrained by the springs 53.

Should a blockage occur on the infeed line, it is best for the means that control the forward motion of the web N to be taken out of operation.

When there is trouble of this nature, which can of course be detected by sensors, the device 24 with which the entire infeed system for the web N is controlled, can be automatically cut off by the Geneva mechanism 25 as described, for example, in Italian Pat. No. 683.846 in the name of the same Applicants as herein.

I claim:

1. Apparatus for producing understrip blanks for hinge lid cigarettes packets, comprising;

a track defining a straight path for a web of understrip material;

feed roll means located on the track for alternately effecting movements and rest periods of the web along the track, the feed roll means having a rotary actuator for rotating them;

scoring roll means located on the track, spaced from the feed roll means, for making in the web fed along the track two rows of indentations generally parallel to the track, with notches regularly spaced along the indentations to define lid-locking protrusions in an understrip, one protrusion corresponding to every notch, the scoring roll means having a rotary actuator for rotating them;

knife means located on the track, spaced from the feed and scoring roll means and extending transversely of the track for separating successive understrip blanks from the web by successive cuts, making one cut during each rest period of the web, the knife means having an actuator for moving it during each rest period of the web; and a drive system for driving the several actuators in exact synchronism with one another to place the notches and the cuts in uniform positions with respect to one another on the successive understrip blanks separated from the web.

2. Apparatus according to claim 1 in which said drive system for the several actuators comprises a rotary drive shaft and a Geneva ratchet driven by said shaft and driving the rotary actuators of the feed roll means and of the scoring roll means.

3. Apparatus according to claim 2 in which said rotary actuators comprise anti-backlash gears between the Geneva ratchet and each of said roll means.

4. Apparatus according to claim 2 in which said knife actuator comprises a cam secured to said drive shaft and a cam follower operating the knife means to make said successive cuts.

5. Apparatus according to claim 4 in which said kinfe means comprises a stationary knife overlying said web and a movable knife driven by said knife actuator to returnably move from below to above the stationary knife, the two knives having edges disposed for making said cuts.

6. Apparatus according to claim 5 in which the movable knife has holder means thereon for holding understrip web material to a surface of said knife during and upon the cutting of a separated understrip blank from the web.

7. Apparatus according to claim 6 in which the holder means comprise a suction system mounted on the movable knife.

8. Apparatus according to claim 5 in which the stationary and movable knives are shaped to make said cuts in successive transverse and oblique forms to provide each understrip blank with a recess in one transverse edge and with a corresponding projection on another transverse edge and with oblique sides of the recess and projection.

9. Apparatus according to claim 1 including means for adjusting the location of the feed and scoring roll means on the track to adjust said effecting of movements and rest periods of the web and said making of indentations and notches.

10. Apparatus according to claim 1 in which the track comprises a first system of guide rails underlying the web and a second system of guide rails overlying the web, each system comprising several guide rails laterally spaced apart, and the feed and scoring roll means being located between the rails of the two systems.

* * * * *